United States Patent [19]

Burge

[11] 4,130,000

[45] Dec. 19, 1978

[54] DRILL STRING SHOCK ABSORBER

[75] Inventor: Edward V. Burge, Houston, Tex.

[73] Assignee: Richard Dean Hawn, Jr., Dallas, Tex.

[21] Appl. No.: 724,541

[22] Filed: Sep. 20, 1976

[51] Int. Cl.[2] ..... F16D 3/06; E21B 17/04; F16F 9/18

[52] U.S. Cl. ..... 64/1 V; 64/23; 175/321; 267/125

[58] Field of Search ..... 64/1 V, 23; 175/318, 175/320, 321; 267/125, 137

[56] References Cited

U.S. PATENT DOCUMENTS

| | | | |
|---|---|---|---|
| 2,712,435 | 7/1955 | Allen | 64/23 X |
| 3,225,566 | 12/1965 | Leathers | 64/23 |
| 3,497,019 | 2/1970 | Ortloff | 175/321 X |
| 3,526,284 | 9/1970 | Burge | 64/23 X |
| 3,606,297 | 9/1971 | Webb | 64/23 X |

*Primary Examiner*—Carlton R. Croyle
*Assistant Examiner*—Leonard E. Smith
*Attorney, Agent, or Firm*—Joseph H. Schley; Thomas L. Cantrell

[57] ABSTRACT

A shock absorber from an oil well drill string mounted therein adjacent its drill bit to cushion drill bit impacts in hard formations and having an elongate tubular mandrel, for connection with said bit, slidably mounted in and drivingly connected to an elongate tubular housing coupled in the drill string. Tubular housing is composed of upper, intermediate and lower tubular sections, preferably; the uppermost has a bore complementary to and slidably engaged by upper packing means on upper end of mandrel, intermediate section has a bore complementary to and in slidable engagement with the mandrel and the lowermost has an upper bore complementary to and slidably engaged by downwardly biased lower packing means slidably confined upon mandrel and a lower bore complementary to mandrel with slidable drive connection between mandrel and housing therein. Upper and lower packing means coact to provide upper annular sealed chamber therebetween composed of bores of housing sections and containing noncompressible fluid to cushion drill bit impacts; sealing means, at the bottom of bore of lowermost housing section and in slidable engagement with mandrel, coacts with lower packing means to form lower annular chamber enclosing slidable drive connection and containing lubricant therefor; flow control means in lower portion of upper chamber to resist relative upward reciprocation of mandrel.

6 Claims, 12 Drawing Figures

DRILL STRING SHOCK ABSORBER

SUMMARY OF THE INVENTION

A novel shock absorber adapted to be mounted in an oil well drill string for cushioning the impacts created by drilling in rock or other hard formations and having a tubular housing for connection in the string adjacent its drill bit. A tubular mandrel is slidably connected within the housing and projects from its lower end for connection with the usual drill bit of the drill string. The shock absorber housing includes three tubular sections or barrels with its top or uppermost barrel having a longitudinal bore complementary to and slidably engaged by an upper elastic packing assembly carried by the mandrel at its upper end. A lower elastic packing assembly is slidably confined upon a lower portion of the mandrel and its exterior is complementary to and in slidable engagement with a bore extending longitudinally of the upper portion of the bottom or lowermost barrel of the housing.

The intermediate housing section or barrel has a coextensive longitudinal bore, in communication with the bores of the uppermost and lowermost barrels of the housing, complementary to and slidably engaged by an intermediate portion of the mandrel. The elastic packing assemblies coact to provide an upper annular sealed chamber therebetween which is composed of the bores of the housing sections or barrels and which contains a noncompressible fluid to absorb shocks generated by the drill bit in hard formations. An annular flow control assembly or body is mounted in the lower portion of the upper chamber or the upper bore of the lowermost barrel of the shock absorber housing for restricting the upward flow of the cushioning fluid and thereby resist upward reciprocal movement of the mandrel relative to said housing.

A helical spring is confined upon the mandrel between the flow control assembly and lower packing assembly within the upper chamber and is adapted to maintain the elastic material of said lower packing assembly deformed into sealing position and live condition. In its lower portion below the lower packing assembly, the lowermost housing section or barrel has a longitudinal bore which is slidably engaged by a complementary lower portion of the mandrel. One or more sealing rings are mounted in the lower end of this lower bore to form, in coation with the lower packing assembly, a lower annular chamber in the lowermost barrel for enclosing a slidable drive connection between the mandrel and housing and containing a fluid lubricant for the slidable drive connection.

Preferably, a plurality of elongate keys or splines are mounted in and extend longitudinally of the upper end portion of the lower bore or lower annular chamber of the lowermost barrel for slidable engagement within complementary longitudinal channels, grooves or keyways, of about twice the length, in the exterior of the mandrel so as to drivingly connect said mandrel to the shock absorber housing. It is noted that the keyways of the mandrel are spaced equally from one another and may be at least double in number over the splines so that said keyways between and unengaged by said splines function as passages to accommodate the flow of the lubricant upon reciprocal movement of said mandrel relative to the housing. Also, the additional or alternate keyways may be utilized in the event that the spline-engaged keyways become excessively worn.

DESCRIPTION OF A PREFERRED EMBODIMENT

Figure 1:
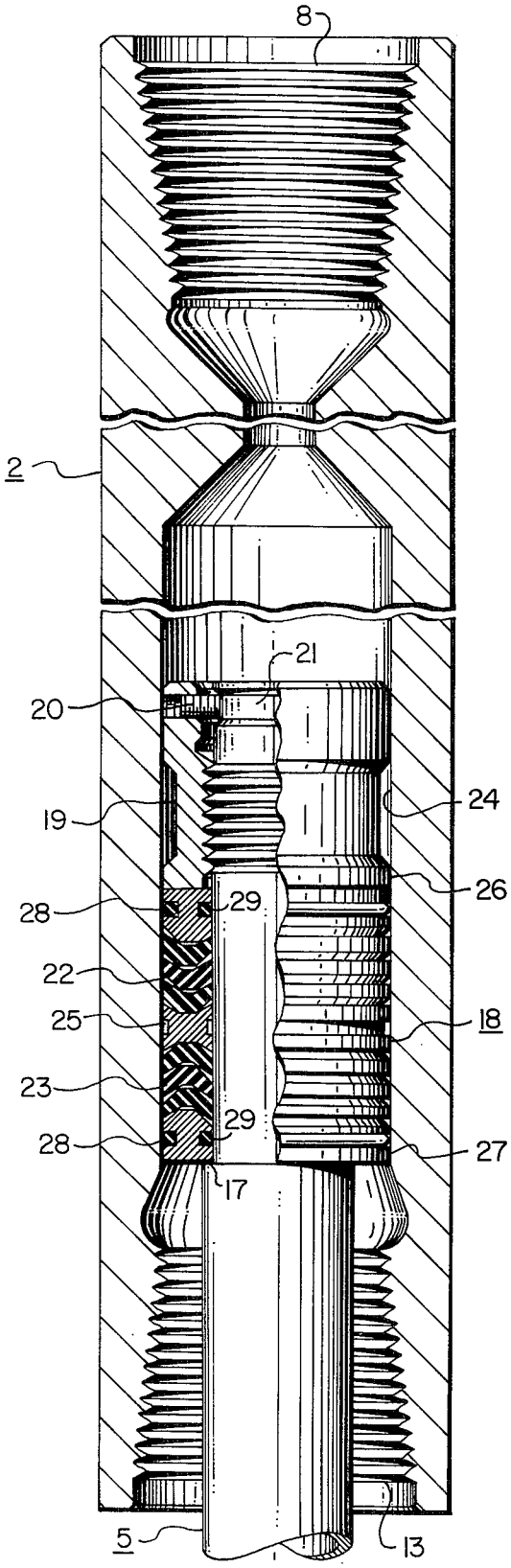
FIG. 1 is a broken transverse vertical sectional view, partly in elevation, of the uppermost or first section of a drill string shock absorber constructed in accordance with the invention and showing the upper end portions of its tubular housing and tubular drive mandrel slidably mounted in the housing at the bottom of its downstroke and carrying and upper packing assembly.
Figure 2:
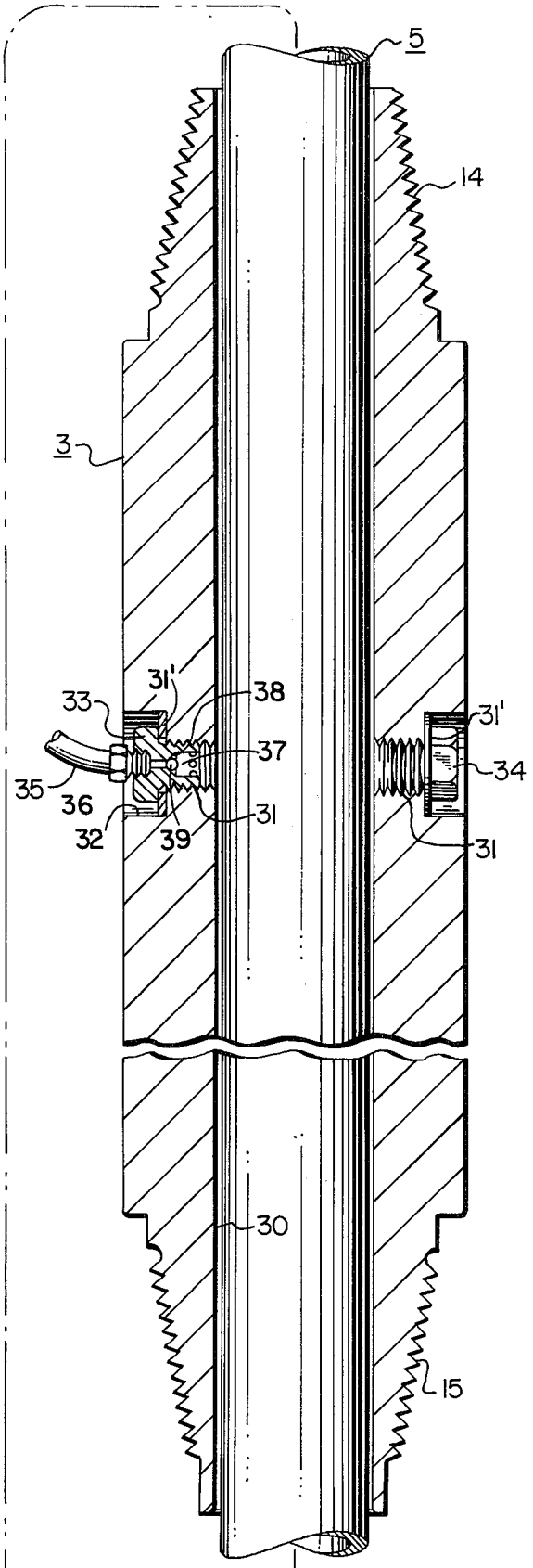
FIG. 2 is a view, similar to FIG. 1, of the intermediate or second section of the shock absorber showing continuations of its housing and slidable drive mandrel as well as the fill fittings of said housing.
Figure 5:
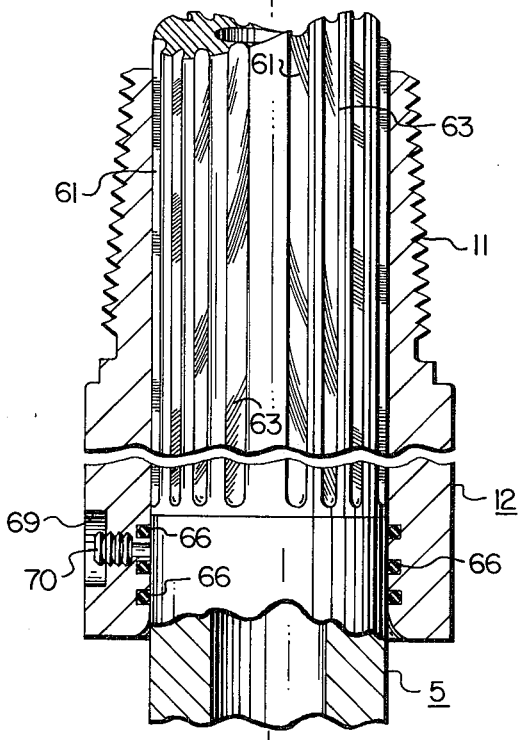
FIG. 5 is a broken longitudinal sectional view, partly in elevation, of the tubular retainer for the lower end of said third shock absorber section and showing the lower ends of the longitudinal channels of said drive mandrel.
Figure 6:
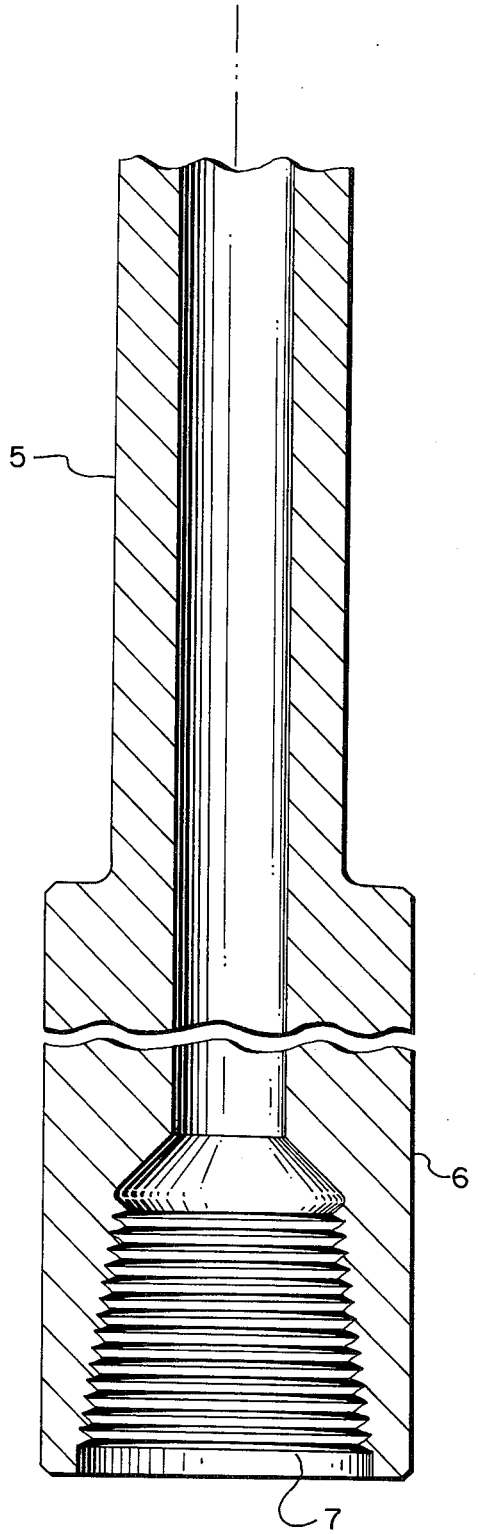
FIG. 6 is a broken longitudinal sectional view of the lower end portion of said mandrel.
Figure 7:
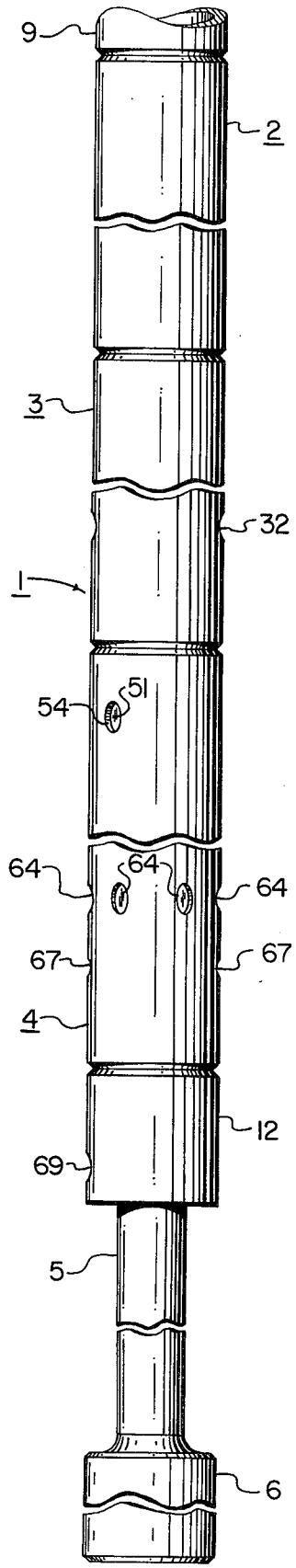
FIG. 7 is a broken side elevational view of said drill string shock absorber with the slidable drive mandrel in its extended or lowermost position.
Figure 8:
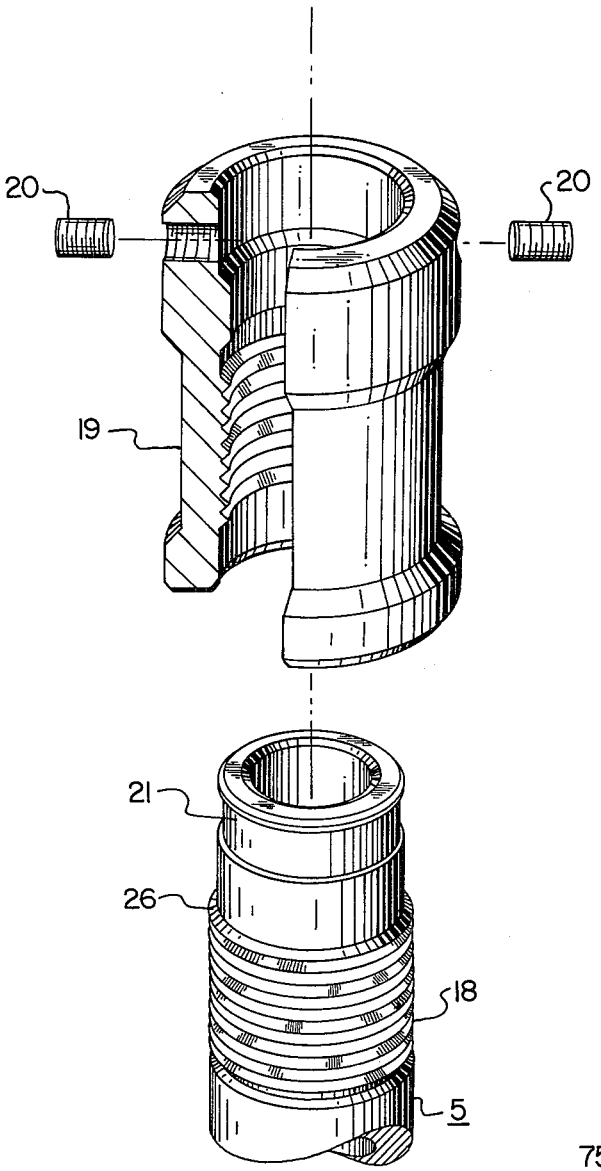
FIG. 8 is an exploded perspective view, partly in section, of the upper end portions of said mandrel and the retainer for confining the upper packing assembly of FIG. 1 thereon.

In FIG. 7 of the drawings, the numeral 1 designates the elongate tubular housing of a novel shock absorber embodying the principles of the invention and adapted to be mounted in an oil well string (not shown) adjacent its drill bit for cushioning the impacts created by drilling in rock or other hard formations. The shock absorber housing 1 comprises three sections that include an uppermost or first tubular member or barrel 2, and intermediate or second tubular member or barrel 3 and a lowermost or third tubular member or barrel 4. An elongate tubular rod or mandrel 5, slidably mounted in the housing sections or barrels 2, 3, 4 for relative reciprocation, has an enlarged head 6 at its projecting lower end for connection with a conventional drill bit (not shown) by means of a screwthreaded box 7 (FIG. 6) formed within the mandrel head. As shown in FIG. 1, a screwthreaded box 8 is provided in the upper end of the first or uppermost barrel or housing section 2 for connection with the complementary lower end of one of the couplings or tool joints 9 (FIG. 7) of the drill string. The lower end of the third or lowermost barrel or housing section 4 has a similar box 10 (FIG. 4) for screwthreaded engagement by a complementary pin 11 (FIG. 5) at the upper end of an elongate tubular retainer 12 (FIG. 7). In effect, this retainer forms a continuation of the lowermost barrel. Again referring to FIG. 1, a screwthreaded box 13 is formed in the lower end of the first barrel 2 for engagement by a complementary pin 14 (FIG. 2) at the upper end of the second or intermediate barrel or housing section 3 which has a similar pin 15 at its lower end for screwthreaded connection with a complementary box 16 (FIG. 3) at the upper end of the third or lowermost barrel or housing section 4.

The upper end portion of the elongate tubular mandrel 5 (FIG. 1) is reduced in diameter to provide an upwardly facing annular shoulder 17 for supporting an upper packing assembly 18 which is removably confined against relative displacement by and overlying tubular retainer or collar 19 screwthreaded on the extremity of said reduced upper end portion of said mandrel. Preferably, one or more radial set screws 20 extend through the retainer 19 and coact with an annular external groove 21 in the upper extremity of the mandrel to lock said retainer to said mandrel. The upper packing assembly 18 includes a pair of upper and lower sets of annular packing elements or rings 22, 23, formed of suitable elastic materal and (preferably) of concavo convex or chevron shape in radial cross-section, encircling the reduced upper end portion of the mandrel 5 in sealing engagement with an annular polished counterbore or enlarged bore 24 in the lower portion of the barrel 2 above its lower box 13. It is noted that the radially convex faces of the upper set of packing rings 22 are directed downwardly toward the upwardly oriented radially convex faces of the lower set of packing rings 23.

A metallic or rigid annular adapter or spacer 25, having complementary radially concave opposed faces, is interposed between the opposed convex faces of the adjacent end rings of the upper and lower packing ring sets; a similar pair of annular end adaptors or retainer rings 26, 27, having a single complementary radially convex face each, respectively overlie and underlie the opposed radially concave faces of the upper and lower end rings of said upper and lower packing ring sets, whereby the flat outer end faces of the end adapters or rings are adapted to engage the flat lower end face of the tubular retainer 19 and the flat face of the mandrel shoulder 17, respectively, so as to maintain the elements of the packing assembly 18 in operative relationship.

As shown at 28, 29 in FIG. 1, annular elastic sealing elements or O-rings are recessed in the respective external and internal peripheries of the annular end adapters 26, 27 for engagement with the mandrel 5 and polished bore 24 of the upper housing section or barrel 2 to seal off therebetween and functions as wipers to substantially prevent or minimize solid particles from engaging and causing premature wear of the chevron packing rings 22, 23.

The second or intermediate barrel 3 (FIG. 2) of the shock absorber housing 1 has an annular coextensive polished bore 30 complementary to the tubular mandrel 5 and of appreciable length so as to center or minimize lateral movement of said rod during its reciprocation relative to said housing. Opposed screwthreaded openings 31 extend radially through the intermediate portion of the wall of this barrel or housing section and are counterbored at their outer ends to provide external recesses 32 for receiving the enlarged polygonal heads of cylindrical plugs 33, 34 screwthreadly engaged in the openings. As shown at 35 in FIG. 2, a flexible oil fill line, hose or tube is adapted to be detachably connected to the plug 33 which is hollow and has counterbores 36, 37 at its respective inner and outer ends. An inwardly facing annular valve seat 38 is provided in the inner counterbore 37 of the hollow plug for coaction with a valve ball 39 confined within said counterbore, while the outer counterbore 36 of said plug is screwthreaded for engagement by the end fitting of the fill line 35. As will be apparent, the annulus between the housing 1 and the mandrel 5 is adapted to be filled with oil or other suitable noncompressible fluid lubricant under pressure by means of the fill line and plugs 33, 34. Plug 34 is removed during initial filling to permit venting of air through opening 31, and then replaced so as to retain the oil or other fluid. Valve seat 38 and valve ball 39 coact to form a check valve for permitting filling through the hollow plug 33 and preventing escape of the pressurized oil or other lubricant. After the filling of the aforesaid annulus, line 35 is detached and outer counterbore 36 of plug 33 is adapted to be closed by a suitable plug or screw which is not illustrated. It is noted that a flat seal ring 31' of ductile metal, such as copper, may be confined within each of the counterbores or recesses 32 of the openings 31 beneath the heads of the plugs 33, 34 to prevent leakage through said openings.

Figure 3:
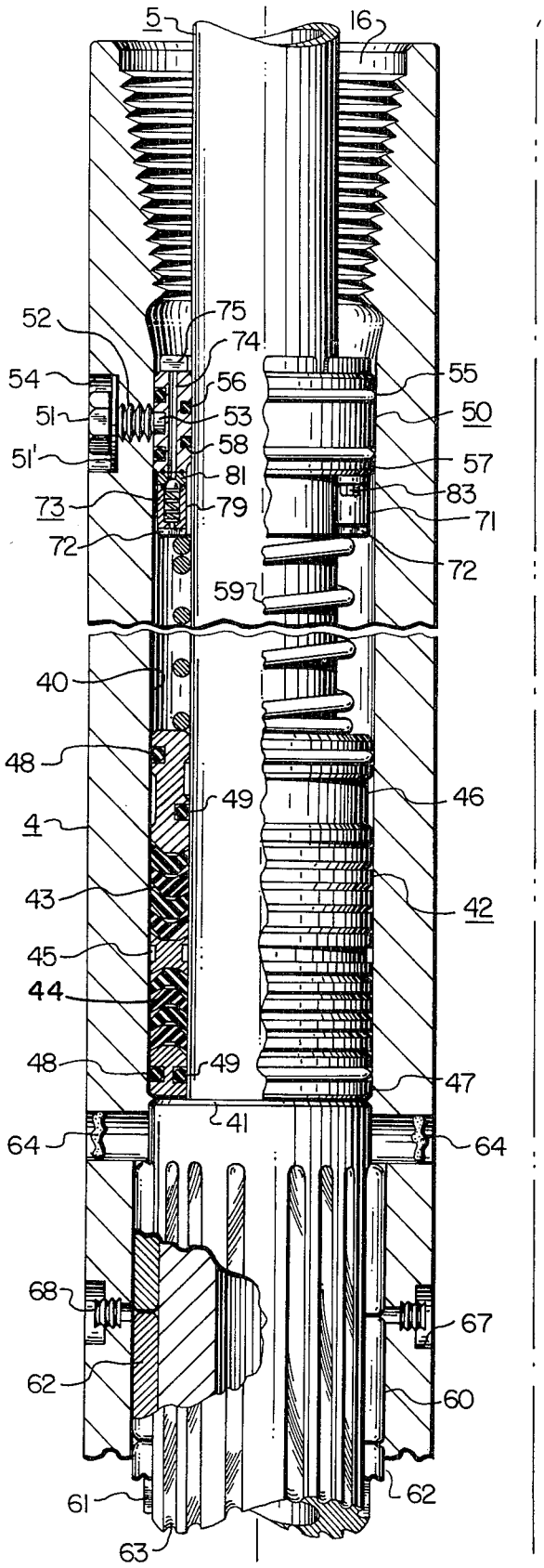
FIG. 3 is a view, similar to FIG. 1, of the lowermost or third shock absorber section showing continuations of its housing and mandrel, a flow control assembly secured within said housing, a spring-pressed lower packing assembly slidably confined on said mandrel between the flow control assembly and the upper end portion of a slidable drive connection of the key and channel type between said mandrel and housing.
Figure 4:
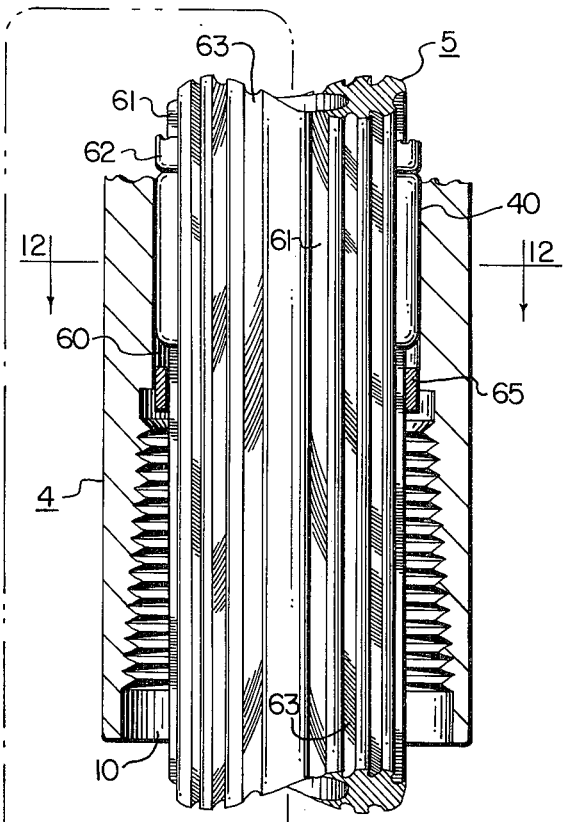
FIG. 4 is a view, similar to and a continuation of FIG. 3, showing the mandrel channels and the lower end portions of said lowermost or third shock absorber section, longitudinal keys and the housing channels of the slidable drive connection.

Referring to FIGS. 3, 4, the lowermost housing section or third barrel 4 has an axial coextensive polished bore 40 between its lower and upper screwthreaded boxes 10, 16 which may be of substantially the same diameter as the polished counterbore or bore 24 of the uppermost or first housing section or barrel 2 and of greater diameter than the mandrel 5 and bore 30 of intermediate or second housing section or barrel 3. As shown at 41 in FIG. 3, the lower portion of the mandrel is of enlarged external diameter to provide an upwardly facing annular shoulder similar to the shoulder 17 (FIG. 1) and supporting a similar lower packing assembly 42. The latter is composed of a similar pair of upper and lower sets of annular packing elements or rings 43, 44 of radial chevron shape and in sealing engagement with the bore 40 of barrel 4, a similar intermediate annular adapter or spacer 45 between the sets of packing rings 43, 44, similar upper and lower annular end adapters or retainer rings 46, 47 and similar O-rings 48, 49 recessed in the external and internal peripheries of the annular end adapters 46, 47. The spaced upper and lower packing assemblies 18 and 42 coact to provide an upper annular chamber between the mandrel and housing which includes the bores 24, 30 and 40 of said housing.

Figure 9:
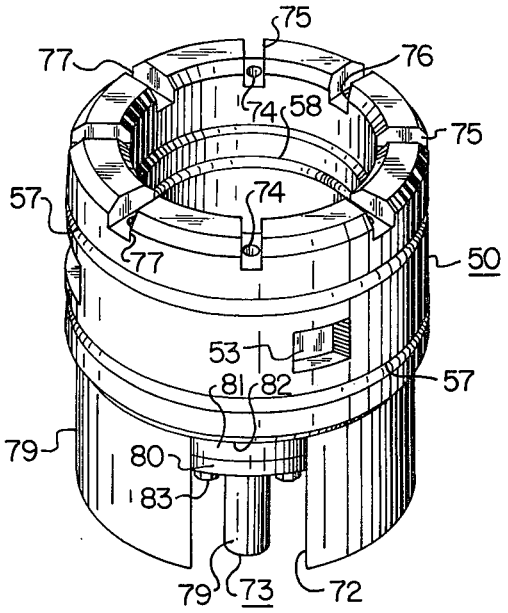
FIG. 9 is a perspective view of the flow control assembly.
Figure 10:
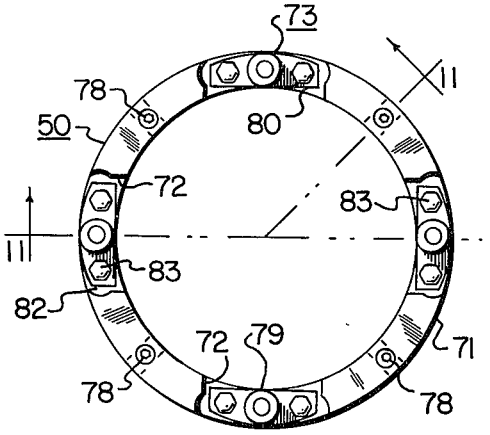
FIG. 10 is a bottom plan view of the flow control assembly.

An annular flow control body or assembly 50 is slidably confined upon the drive mandrel 5 and is secured against movement therewith by a plurality of set screws 51 threaded in and projecting inwardly through complementary screwthreaded radial openings 52 in the wall of the barrel 4 into engagement with recesses 53 (FIG. 9) in the exterior of the valve body. The outer end of each radial opening 52 is enlarged to provide a counterbore 54 for accommodating the enlarged polygonal head of each set screw 51. Preferably, a flat seal ring 51' of copper or other ductile metal is confined beneath the head of each set screw to prevent leakage through its opening. Pairs of annular sealing elements or O-rings 55, 56 are mounted in pairs of annular grooves 57, 58 provided in the exterior and interior, respectively, of the flow control body 50 so as to engage and seal off between the respective peripheral surfaces of said body, the bore 40 of the barrel or housing section 4 and the exterior of the mandrel 5, while permitting reciprocation of said mandrel relative to said barrel.

A helical spring 59 surrounds and is confined upon the drive mandrel between the flat upper surface of the upper end ring or adapter 46 of the lower packing assembly 42 and the lower end of the flow control body so as to exert a constant downward force against said packing assembly for resisting rotation of its upper and lower sets of packing rings 43, 44 as well as its adapter or spacer rings 45, 46, 47 and thereby minimize wear of the polished bore 40. Also, the downward force of the spring 59 maintains the packing rings in deformed condition so as to prolong the life thereof and resists upward movement of the mandrel relative to the shock absorber housing. It is pointed out that the oil within the upper annular chamber, which includes the bores 24, 30 and 40, is under pressure and exerts a force which not only resists relative reciprocation of the mandrel 5 but coacts with the helical spring in resisting upward movement of the lower packing assembly with said mandrel.

Figure 12:
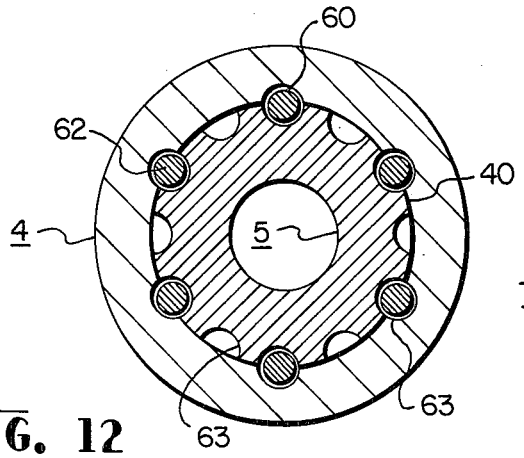
FIG. 12 is a horizontal cross-sectional view taken on the line 12—12 of FIG. 4 to show the relationship of the longitudinal channels of said housing and mandrel to one another and to said drive keys.
Figure 11:
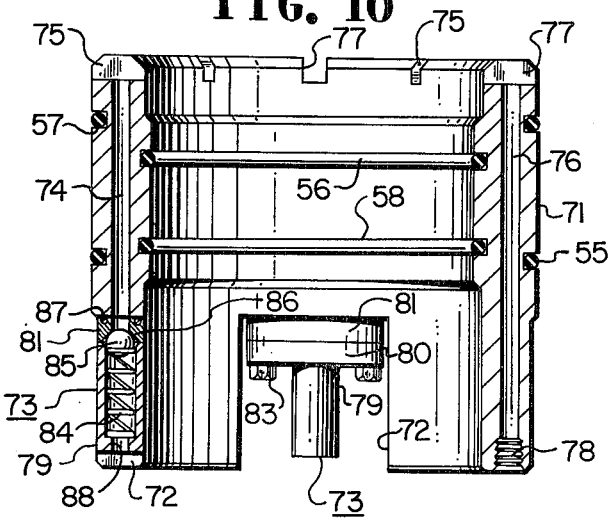
FIG. 11 is a horizontal cross-sectional view taken on the line 11—11 of FIG. 10 to show one each of the check valves and flow passages of said flow control assembly.

As shown in FIGS. 3, 4, 5, 12, a multiplicity of longitudinal parallel equally spaced grooves, channels or keyways 60 extend axially of the lower portion of the bore 40 of the lowermost housing section or barrel 4 and are semicircular in cross-section for coacting with complementary channels, grooves or keyways 61 formed in the exterior of the drive mandrel 5. The mandrel channels or grooves 61 are of much greater length than the barrel channels or grooves 60 so as to permit reciprocation of the mandrel relative to said barrel and its channels. Elongate cylindrical drive elements, splines or keys 62, preferably divided into sections, are adapted to be confined in the respective coacting channels or keyways 60, 61 of the barrel interior and mandrel exterior to drivingly and slidably connect said mandrel to the shock absorber housing 1 and permit relative reciprocal movement of the mandrel. As best shown in FIG. 12, identical equally spaced channels or grooves 63 are interposed between the mandrel channels or grooves 61 whereby said mandrel channels or grooves 61 and 63 are disposed in alternate relationship and either set of them may be utilized as keyways, while the other or alternate channels or grooves serve as longitudinal fluid passages between the barrel bore 40 and mandrel to facilitate the flow of oil or other noncompressible fluid between the portions of the annulus or chamber above and below the keys 62 during relative reciprocation of said mandrel (FIG. 13). Also, the alternate channels of the mandrel may be utilized as keyways in the event the other channels become excessively worn.

As shown at 64 in FIGS. 3, 7, cylindrical plugs close radial relief openings drilled in the lowermost barrel at the upper ends of its longitudinal channels or grooves 60 in which the keys 62 are confined and have their inner ends flush with the fbore of said barrel so as to seal the upper ends of said channels. A wear ring 65 (FIG. 4) is mounted in the lower end of the bore 40 of barrel 4 and is adapted to be engaged by the inner extremity of the pin 11 of tubular retainer 12 (FIG. 5) when said pin is screwthreaded into the box 10 at the lower end of said barrel for limiting endwise movement of the keys.

For closing or sealing off the lower end of the interior or bore of the tubular retainer 12, which bore forms a continuation of the bore 40 of the barrel 4, a plurality of annular sealing elements or O-rings 66, such as three, are recessed in said bore lower end so as to sealingly bear against the polished exterior of drive mandrel 5 below its channels 61, 63. The rings 66 coact with the sealing rings 48, 49 of the lower packing assembly 42 (FIG. 3) to prevent the escape of grease or other similar lubricant injected into the lower portion of the annulus or lower annular chamber, formed by said rings between the mandrel and shock absorber housing, through diametrically-opposed radial openings 67 provided in the barrel 4. The latter openings communicate with the upper end portions of an opposed pair of the keyways 60 of the bore 40 of the barrel and are adapted to be closed by complementary plugs 68 screwthreaded thereinto. During injection of the grease, both plugs 68 are removed so that one of the openings 67 functions as a vent. If desired, grease or other similar lubricant may be injected into the lower extremity of the bore of the retainer 12 (FIG. 5) between a pair of its internal sealing rings 66, preferably its uppermost pair, through a radial opening 69 in the wall of said retainer that is adapted to be closed by screwthreading a complementary plug 70 thereinto.

As best shown in FIGS. 3, 9, 10, 11, the annular flow control body or assembly 50 includes a cylindrical collar 71 having a plurality of equally spaced slots or recesses 72 extending radially and axially through its lower end for accommodating upwardly closing check valves 73. A plurality of ports 74, extending axially through the collar 71, establish communication between the upper ends of the check valve 73 and aligned notches 75 in the top of said collar. Alternately between the ports 74 and notches 75, the collar has axially extending cylindrical passages 76 with overlying notches 77 in its upper end. Preferably, flow through the passages 76 is controlled by the internal diameter of annular orifice plugs 78 screwthreaded into the lower ends of said passages. It is noted that one or more of the orifice plugs 78 may have different internal diameters for varying the combined flow through the passages 76.

Each of the check valves 73 (FIG. 11) comprises a cylindrical tubular casing 79, which is laterally flanged at its upper or inner end to provide an oblong flat mounting bracket 80, and an annular valve seat member 81 which has lateral ears 82. Bolts 83 project through openings in the bracket 80 and ears 82 for detachably connecting the casing 79 and valve seat member 82 to the bottom or downwardly facing underside of the collar 71 within each slot 72. Each tubular valve casing has a helical spring 84 within its bore for constantly urging a valve ball 85 upwardly or inwardly into engagement with an annular complementary downwardly or outwardly facing seat 86 formed in the member 81. An O-ring 87 is recessed in the upper side of each valve seat member for sealing off between said member and the bottom wall of each slot. As shown by the numeral 88, the lower end of the bore of each valve casing is reduced to provide an annular upwardly facing shoulder for supporting the helical spring.

In operation, the shock absorber is fully extended as best shown in FIG. 7 with the lower packing assembly 42 in the lower portion of the third or lowermost barrel 4 adjacent the upper ends of the keys or splines 62 (FIG. 3) whereby an appreciable portion of the mandrel 5 depends below said barrel and positions its head 6 a considerable distance from the housing 1 of said shock absorber. Also, the upper packing assembly 18 (FIG. 1) is in the lower portion of the counterbore or bore 24 of the first or uppermost barrel 2 with the result that most of the fluid within the annulus or annular chamber, formed by said counterbore in coaction with the bore 30 and 40 of the barrels 3 and 4 between the packing assemblies, is disposed below the flow control assembly or body 50. Since the valve balls 85 of the check valves 73 (FIG. 11) are held in engagement with the valve seats 86 by the helical springs 84, upward movement of the mandrel is resisted because the fluid can be displaced upwardly only through the orifice plugs 78 of passages 76. When the drill bit (not shown) strikes a hard formation, the mandrel 5 moves upwardly in accordance with the flow restriction provided by the orifice plugs of passages 76 and the check valves snap closed. The fluid below the flow control assembly 50 cushions the upward thrust of the mandrel and is slowly forced through the passages 76 of said assembly or body (FIGS. 3, 9, 11) by the upward travel of the lower packing assembly 42 with said mandrel so as to compress the helical spring 69 between said assemblies.

Upon cessation of this upward thrust, the pressure of the drilling fluid constantly exerted against the relatively large area of the upper end of the upper packing assembly 18 urges the mandrel downwardly to at least a partially extended position (FIG. 7). Since the upper packing assembly 18 forces the fluid downwardly, the check valves 73 open to permit downward flow through the ports 74 whereby the downward reciprocation of the mandrel 5 is much faster than its upward movement. It is noted that the shock absorber is of benefit also in marine drilling, particularly, when the drill string is suspended from a vessel or other floating platform. During such drilling, the entire drill string is subject to reciprocation by the movement of the waves and causes the drill bit to strike the bottom of the borehole. Due to the cushioning action of the shock absorber, damaging of the drill string and its bit as a result of violent reciprocation is minimized. As noted hereinbefore, the shock absorber maintains a constant weight on the drill bit by permitting controlled reciprocation between the housing and mandrel and preventing suspension of said bit off of the bottom of the borehole.

The foregoing description of the invention is explanatory thereof and various changes in the size, shape and materials, as well as in the details of the illustrated construction may be made, within the scope of the appended claims, without departing from the spirit of the invention.

I claim:

1. A shock absorber for a drill string including a tubular housing adapted to be connected in a drill string adjacent its lower end, a tubular mandrel slidably mounted in the tubular housing and projecting from its lower end, upper and lower spaced packing means mounted on and surrounding the mandrel for sealing off between said housing and mandrel and forming therebetween an upper annular chamber in said housing, means below the lower packing means for slidably and drivingly connecting said mandrel to said housing for rotation therewith, the upper housing chamber containing a noncompressible fluid for cushioning relative reciprocation between said mandrel and housing, flow control means mounted in said upper chamber between the upper and lower packing means for controlling the flow of the fluid upon said relative reciprocation and for restricting upward flow of said fluid from below to above the flow control means so as to resist upward reciprocation of said mandrel relative to said housing, said lower packing means being slidably confined upon said mandrel, said restriction of upward fluid flow upon relative upward reciprocation of said mandrel creating fluid pressure between said flow control means and lower packing means for urging the latter downwardly away from said flow control means so as to permit limited upward reciprocal movement of said mandrel relative to said lower packing means, sealing means in the lower end portion of said housing for packing off between the lower portions of said mandrel and housing below the means for slidably and drivingly connecting said mandrel to said housing, the sealing means coacting with said lower packing means to form a lower annular chamber therebetween of sufficient length to enclose said slidably and drivingly connecting means and adapted to contain a fluid lubricant therefor, said tubular housing having a bore in its upper portion complementary in diameter to said upper packing means and forming at least a portion of said upper annular chamber of said housing, said upper packing means being confined upon the upper end portion of said tubular mandrel in slidably engagement with the bore in the upper portion of said housing, said housing having a bore in its lower portion complementary in diameter to said lower packing means and forming at least a portion of said upper annular housing chamber, said lower packing means being in coacting slidable engagement with the bore in the lower portion of said housing as well as the exterior of said mandrel.

2. A shock absorber as defined in claim 1, wherein said tubular housing has a bore in its intermediate portion complementary in diameter to said exterior of said tubular mandrel for slidable engagement therewith and forming at least a portion of said upper annular chamber of said housing.

3. A shock absorber as defined in claim 1 wherein the lower end portion of said tubular housing has a lowermost bore complementary in diameter to a lower portion of said tubular mandrel, said sealing means and at least a portion of said means for slidably and drivingly connecting said mandrel to said housing being disposed within the lowermost bore of said housing.

4. A shock absorber for a drill string including a tubular housing adapted to be connected in a drill string adjacent its lower end, a tubular mandrel slidably mounted in the tubular housing and projecting from its lower end, upper and lower spaced packing means mounted on and surrounding the mandrel for sealing off between said housing and mandrel and forming therebetween an upper annular chamber in said housing, means below the lower packing means for slidably and drivingly connecting said mandrel to said housing for rotation therewith, the upper housing chamber containing a noncompressible fluid for cushioning relative reciprocation between said mandrel and housing, flow control means mounted in said upper chamber between the upper and lower packing means for controlling the flow of the fluid upon said relative reciprocation and for restricting upward flow of said fluid from below to above the flow control means so as to resist upward reciprocation of said mandrel relative to said housing, said lower packing means being slidably confined upon said mandrel, said restriction of upward fluid flow upon relative upward reciprocation of said mandrel creating fluid pressure between said flow control means and lower packing means for urging the latter downwardly away from said flow control means so as to permit limited upward reciprocal movement of said mandrel relative said lower packing means, sealing means in the lower end portion of said housing for packing off between the lower portions of said mandrel and housing below the means for slidably and drivingly connecting said mandrel to said housing, the sealing means coacting with said lower packing means to form a lower annular chamber therebetween of sufficient length to enclose said slidably and drivingly connecting means and adapted to contain a lubricant therefor, and resilient means interposed between said flow control means and lower packing means for constantly urging said packing means downwardly away from said flow control means so as to maintain said packing means in deformed sealing position.

5. A shock absorber as defined in claim 4 wherein said tubular housing has a bore in its upper portion complementary in diameter to the upper packing member and forming at least a portion of said upper annular chamber of said housing, said upper packing means being confined upon the upper end portion of said tubular mandrel is slidable engagement with the bore in the upper portion of said housing, said housing having a bore in its lower portion complementary in diameter to said lower packing means and forming at least a portion of said upper annular housing chamber, said lower packing means being in coacting slidable engagement with the bore in the lower portion of said housing as well as the exterior of said mandrel.

6. A shock absorber as defined in claim 4 wherein said tubular housing has a bore in its intermediate portion complementary in diameter to said exterior of said tubular mandrel for slidable engagement therewith and forming at least a portion of said upper annular chamber of said housing.

* * * * *